US008138978B1

(12) United States Patent
Vier et al.

(10) Patent No.: US 8,138,978 B1
(45) Date of Patent: Mar. 20, 2012

(54) INTEGRATED EXTERNAL ANTENNA

(75) Inventors: Bradford Edward Vier, Austin, TX (US); Don A. Bobo, Leander, TX (US); Todd Winfield Steigerwald, Austin, TX (US); Loren Howell, Georgetown, TX (US); Andrew Love, Liberty Hill, TX (US)

(73) Assignee: Motion Computing, Inc., Austin, TX (US)

( * ) Notice: Subject to any disclaimer, the term of this patent is extended or adjusted under 35 U.S.C. 154(b) by 902 days.

(21) Appl. No.: 11/972,982

(22) Filed: Jan. 11, 2008

(51) Int. Cl.
*H01Q 1/24* (2006.01)

(52) U.S. Cl. ..... 343/702

(58) Field of Classification Search ..... 343/702, 343/846, 793–795, 900–902, 906; 455/90
See application file for complete search history.

(56) References Cited

U.S. PATENT DOCUMENTS

| | | | | |
|---|---|---|---|---|
| 5,907,306 | A * | 5/1999 | Karabinis et al. | 343/702 |
| 6,107,969 | A * | 8/2000 | Gulino et al. | 343/702 |
| 6,181,284 | B1 | 1/2001 | Madsen et al. | |
| 6,232,924 | B1 * | 5/2001 | Winstead et al. | 343/702 |
| 6,266,017 | B1 | 7/2001 | Aldous | |
| 6,297,779 | B1 | 10/2001 | Tsai | |
| 6,359,591 | B1 * | 3/2002 | Mou | 343/702 |
| 7,167,726 | B2 | 1/2007 | Ghosh et al. | |
| 7,579,993 | B2 * | 8/2009 | Lev et al. | 343/702 |

* cited by examiner

*Primary Examiner* — Huedung Mancuso
(74) *Attorney, Agent, or Firm* — Charles D. Huston; Daffer McDaniel, LLP

(57) ABSTRACT

An antenna system for an electronic device enables the device to communicate via numerous wireless communication protocols, such as wireless broadband communication protocols. The antenna is able to extend from the body of the electronic device in order to meet efficiency and specific absorption rate requirements, while retracting into the footprint of the device when not in use. The antenna is easily disassembled and reassembled from the device without the use of tools, and may automatically disassemble from the device in order to avoid sustaining damage or exposing a user to excessive electromagnetic radiation.

21 Claims, 4 Drawing Sheets

INTEGRATED EXTERNAL ANTENNA

BACKGROUND OF THE INVENTION

1. Field of the Invention

The present invention relates in general to the field of electronic devices and, more particularly, to an antenna system for an electronic device having a range of antenna positions to optimize antenna performance without exposing a user to excessive radiation.

2. Description of the Related Art

The following descriptions and examples are not admitted to be prior art by virtue of their inclusion within this section.

Many electronic devices are designed to communicate via a wireless transmission protocol. Most portable computers are now purchased with built in wireless networking capability using communications protocols such as, for example, 802.11a, b, or g wireless local area networking (WLAN), Bluetooth, and wireless wide area networking (WWAN). Electronic devices that connect to a WWAN, such as portable computers that are able to connect to an existing mobile broadband service, are gaining in popularity. Connection with such a network requires the computer to transmit radio frequency (RF) signals and receive transmissions of RF signals from other similarly capable devices such as wireless access points, wireless routers, and other electronic devices. As such, electronic devices may conceal a multitude of antennas to execute transmissions via these various radio frequency protocols.

An antenna functions by transmitting and receiving RF waves, or, RF electromagnetic energy. As such, a functioning antenna consumes energy and emits it in the forms of heat and emitted RF energy. In other words, energy that is input to the antenna and not radiated as electromagnetic energy is dissipated as heat. The percentage of energy consumed by the antenna that is dissipated as RF electromagnetic energy is known as the antenna's efficiency. Antenna efficiency may be an important characteristic of an electronic device because it serves as a measure of how much energy is required to power the antenna. Antenna efficiency may also be used to indicate signal strength in cases where a transceiver draws a fixed amount of power. Since power consumption may affect device performance, it is normally desirable to have an antenna that is somewhat efficient. One problem with many typical antenna designs is that they do not extend beyond the body of the electronic device. As such, the structure of the device may inhibit RF radiation, and thereby cause the antenna to operate inefficiently by reducing the proportion of antenna power that is emitted as RF radiation.

Another important aspect of antenna operation is the effect of RF radiation on the human body. When a user sits in close proximity to an antenna, their body may absorb a portion of the electromagnetic energy that is emitted by the antenna. This can be dangerous in some cases because exposure to RF electromagnetic radiation may cause biological tissue to heat rapidly. As a result, regulatory bodies, such as the Federal Communications Commission (FCC) in the United States and the European Commission (EC) in the European Union, promulgate safety regulations that limit the extent to which a device may expose a user's body to radiated electromagnetic energy. These regulations function by limiting the specific absorption rate associated with a device. Here, specific absorption rate (SAR) is a measure of the amount of RF energy that an amount of biological tissues absorbs when exposed to an RF electromagnetic field. SAR, normally expressed in watts per kilogram (W/kg) or milli-watts per gram (mW/g), is limited by regulatory bodies for many transmitting electronic devices. The FCC and EC require that all radio transmitting devices pass a specific absorption rate requirement.

As noted above, SAR is generally measured in terms of the amount of energy that will be absorbed by a mass of tissue. However, SAR requirements may vary based on the intended use of the device. For instance, a device that is meant to be in contact with a user's head may be subject to a more stringent SAR requirement because the head is a sensitive part of the body. Thus, SAR limits may be expressed in several ways. For example, in the United States a spatial average limitation functions to limit the amount of energy absorbed over the entire body of the user over a period of time to 0.08 W/kg; a spatial peak limitation functions to limit the amount of energy absorbed by any one particular (cube shaped) gram of tissue averaged over a period of time to 1.6 W/kg; and a spatial peak limitation applied to less sensitive parts of the body functions to limit the amount of energy that may be absorbed over a period of time to 4 W/kg.

SAR measurements will decrease exponentially over distance. This means that a device that employs an internal antenna, such as a laptop computer with a folding liquid crystal display, may more easily meet SAR requirements than a device with an external antenna by creating a cushion space between the antenna and the user. Conversely, an engineer may encounter some difficulty when seeking to maintain SAR compliance while designing an electronic device with a flat profile, such as a tablet computer or personal digital assistant (PDA) because there is no component of the device that can be assumed to protrude away from the body of the user. These types of devices are also poorly suited for incorporating an internal antenna because the body of the device will limit the efficiency of the antenna. As a result of these concerns along with the increasing popularity of flat profile electronic devices that are able to communicate wirelessly, integrated external antennas are becoming increasingly popular. Unfortunately, adding an external antenna to these types of products may require compromises in the mechanical or industrial design of the product because antenna design considerations may counteract each other. For instance, while it is desirable to keep the antenna at optimal efficiency, doing so may be difficult without compromising the aesthetic appearance of the product, inhibiting the utility of the device, or making the device less robust.

Further, while it may be easy to accomplish higher antenna efficiency with an external design, external antennas are generally more fragile, obtuse in appearance, and difficult or expensive to replace when they become damaged. Also, external antennae must be kept away from the body of the user so that the device will comply with SAR requirements. Traditional antenna designs, including telescoping antennae and flexible antennae fall short in addressing these shortcomings. Telescoping antennae, which are commonly used in external antenna designs, are typically made from a thin wall metal which makes them fragile and easy to damage. Flexible antennae, such as an antenna composed of a flexible radiating element and coating, are prone to surface coating cracking and fatigue failure. By failing, either of these antennae designs may cause costly repairs for an end user, and may ultimately require a manufacturer to expend time and resources providing technical support to help an end user replace their antenna.

Accordingly, it would be desirable to create an external antenna design that is optimized in terms of efficiency, while also achieving pleasing aesthetics and a robust design. It is also imperative that the antenna design can be implemented in a way that will offer compliance with FCC and EC SAR level limits.

SUMMARY OF THE INVENTION

To resolve the aforementioned antenna design challenges, an antenna design that is able to effectively protrude from the body of an electronic device without becoming susceptible to damage or causing the device to exceed SAR limitations is disclosed.

In one embodiment, an antenna apparatus is disclosed. The antenna apparatus comprises an antenna housing having opposed distal ends that at least partially surrounds a radiating element; a cylindrically shaped pin located near one of the distal ends and extending from a side of the housing, wherein a central axis of the pin serves as an axis of rotation for the antenna; and a detent that is shaped to palpably engage the housing in a fixed position when the housing is rotated to a first angle.

An electronic apparatus is also disclosed, comprising an electronic apparatus housing that has a planar surface on which an electronic display is mounted and side surfaces along the lateral extents of the planar surface. The electronic apparatus housing may also have an aperture extending into one of the side surfaces. The electronic apparatus also comprises an antenna having a pin extending from a side surface of the antenna near one of a pair of opposing distal ends of the antenna; a set of arcuate protrusions mounted on the antenna and spaced radially outside the pin; a first cam mounted on the antenna and radially outside the set of protrusions; a second cam mounted on the computer and spaced radially outside the aperture. The first and second cams may be configured to engage and disengage with each other when the pin is rotably inserted into the aperture.

A method for extending an antenna is also disclosed. The method comprises inserting a fingertip into a recess within a side surface of a electronic system housing, between the recessed portion of the side surface and an antenna housing; applying force onto the antenna housing in a direction substantially perpendicular to a planar surface of the electronic system housing having an electronic display; applying rotational force onto the antenna to rotate the antenna about a pivot point at which only one end of the antenna is rotably affixed to the side surface of the electronic system housing; and discontinuing the application of rotational force when detents on the antenna housing palpably engages with mating detents on the computer housing;

Further, an antenna system is disclosed that comprises an internal assembly and an external assembly. The external assembly comprises an intermittently placed, arcuate set of protrusions extending from a first side surface of the antenna near one of a pair of distal ends of the antenna and a singular pin also extending along an axis extending equidistant from each of the set of protrusions from the first side surface. The singular pin is biased outward along the axis and against an oppositely biased contact plate when the protrusions are rotably inserted into an aperture. Here, the internal assembly may comprise a circular recess configured to receive the intermittently placed, arcuate set of protrusions and a contact plate, biased toward the external assembly, wherein the contact plate is coupled to a transceiver.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
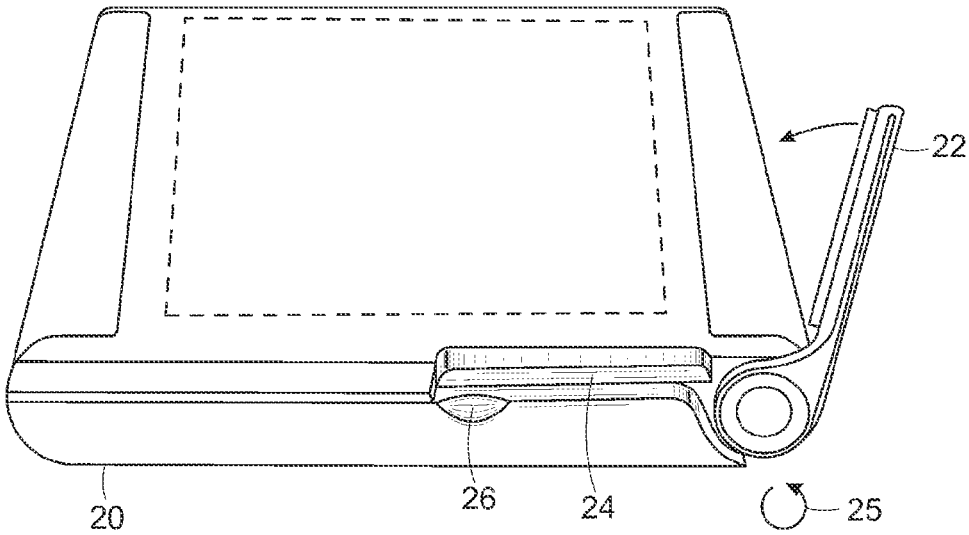
FIG. 1 is a plan view showing an exemplary electronic device that includes an embodiment of the integrated external antenna in its extended position.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but are instead intended to cover all modifications, equivalents and alternatives falling within the spirit and scope of the present invention as defined by the appended claims.

DETAILED DESCRIPTION OF THE PREFERRED EMBODIMENTS

In response to the problems and limitations outlined above, a more robust antenna system is disclosed to increase efficiency, conform to the appearance of an electronic device and manage the extent to which a user is exposed to electromagnetic radiation. The antenna design may be incorporated into many types of electronic devices, including tablet computers, notebook computers, personal digital assistants, wireless telephones, and similar devices. The antenna system may enable an electronic device to communicate with a wireless communications network or device, such as a wireless access point, wireless local area network (LAN), cellular telephone networks (wireless wide area network, or WWAN), and similar devices or networks.

Turning to the drawings, FIG. 1 is a plan view showing an exemplary electronic device, a tablet computer, with an extendable external antenna. The antenna 22 may be located along a top edge of an electronic device near a corner of the device 20. The antenna 22 of the antenna system may be a monopole antenna, but any suitable type of antenna, such as dipole or slotted antenna, may be used depending upon factors such as desired polarization and radiation patterns, or type of wireless communication system. The antenna system may be used with any suitable wireless communication system. In particular, the antenna system may preferably conform to CDMA2000 1xEV-DO Rev.A, or any similar communications protocol, which will allow the device to connect to long range wireless broadband networks, or WWANs.

The antenna system includes an external radiating element made from a metallic material, such as a beryllium copper alloy. The external radiating element may be plated with gold, tin or another material with similar electrical properties, and may be passivated. In a preferred embodiment, the external radiating element is plated with gold at all points of contact, and at all moving points, such as pivot points or spring loaded contacts. The external radiating element may be stamped or otherwise formed into an ideal shape that is tuned for the antenna's intended use. The external radiating element may then be placed between two pieces of a molded plastic material that are sonically welded together around the external radiating element. In a preferred embodiment, the plastic material may be an acetyl resin, such as polyoxymethylene or DuPont's Delrin, or a similar plastic material that is low friction, lightweight, durable, and resistant to wear. The molded plastic pieces may serve to protect the metallic external radiating element and allow the antenna to form a more complex shape that embraces the design of the electronic device. The plastic may also enable a simple fabrication method that facilitates the incorporation of complex physical features, such as shapes, spring properties, and fatigue characteristics. It is noted that size and configuration of the antenna elements may vary. In particular, sizes and shapes of the elements may change depending on the intended use of the antenna as well as the appearance of the electronic device.

To connect to a device, the external radiating element may connect to a gold plated pogo pin that is press fit into the subassembly comprising the plastic and external radiating elements. The pogo pin is discussed in more detail in FIGS. 3 and 4, and is spring loaded at each end. The pogo pin may be in contact at its end opposite from the external radiating element with a spring loaded contact plate that is coupled to a printed circuit board (PCB) radio via a soldered gold monolith structure. The PCB radio, which controls the antenna, is in turn grounded through the chassis of the electronic device. It is noted that the elements extending from the PCB after the connection to ground, including the contact plate, pogo pin, and external radiating element essentially function as a radiating assembly. In order to transmit and receive a clear signal, the radiating assembly must be shielded from electrical noise produced by the device. This may be accomplished by using a copper plate to isolate and shield the radiating assembly from noise producing components of the device. In order to transmit a clear signal, the radiating assembly must be must be shielded from electrical noise produced by the device. This may be accomplished by using a copper plate to isolate and shield the radiating assembly from noise producing components of the device.

Figure 2:
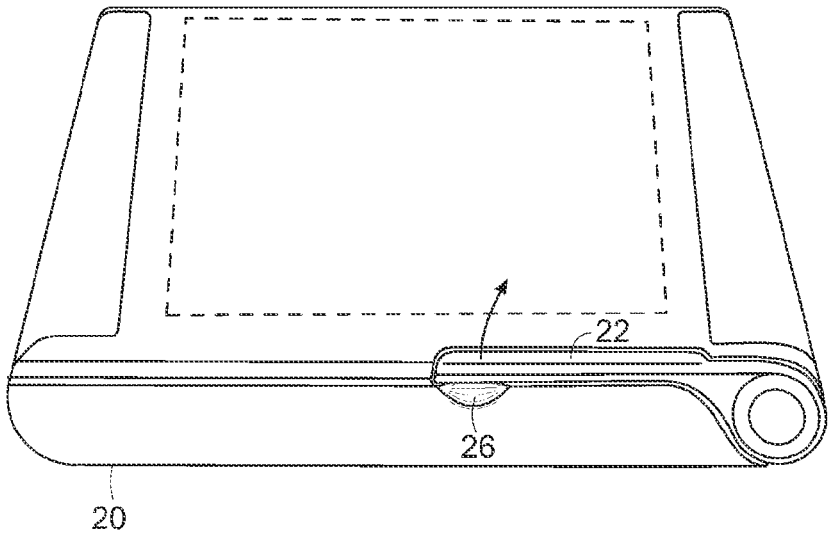
FIG. 2 is a plan view showing an exemplary electronic device that includes an embodiment of the integrated external antenna in its closed position.

Returning to FIG. 1 the electronic device includes extendable external antenna 22 that rotates along an axis of rotation 25 that runs along the back of the device 20, preferably parallel to rear surface of the device. Here, the antenna 22 is designed so that when it is rotated into the closed position, as shown in FIG. 2, it will fit within a recess 24 that is designed into the body of the electronic device 20. The body of the device 20 is also shaped with an additional recess 26, or scoop, that allows a user to easily extend the antenna 22 with their finger. Essentially, the finger scoop recess 26 is a small indention, located near the end of the antenna that can be easily grasped and extended, that serves to allow the antenna 22 to be easily manipulated by a person's finger.

Antenna performance characteristics, such as gain, efficiency, and specific absorption rate (SAR), may vary dramatically depending on whether the external antenna 22 is in the extended position shown in FIG. 1, or in the closed position shown in FIG. 2. When the antenna 22 is in the closed position, more of the RF energy that the antenna 22 seeks to radiate will be absorbed by the device 20. As a result, the antenna 22 will be less efficient in this closed position and therefore less likely to meet a specification that requires minimum antenna efficiency, such as a certification requirement of a wireless broadband (or WWAN) service provider. For instance, a particular service provider may require a device's antenna to operate at forty percent efficiency in order to be certified for use on their network. The rationale for this higher efficiency requirement is that the antenna 22 will be able to reliably transmit and receive RF signals while drawing only a set amount of power from the device 20. This heightened efficiency may help to ensure high quality RF signal reception and transmission between the electronic device and a remote RF device, such as a cell tower of a wireless broadband provider. Accordingly, an engineer may not have to implement intensive firmware activities to enable effective processing of a lower quality signal, thereby decreasing the need to implement undesirable firmware activities that may inhibit RF throughput as well as the performance of the remote RF device.

In order to increase the efficiency of the antenna 22, it may be necessary for a user to move the antenna toward its extended position by inserting a finger into the finger pull recess 26, grasping the lower surface of the antenna 22 and pulling the antenna 22 upward to an extended position. Because the antenna 22 is further from the body of the device 20 when in the fully extended position shown in FIG. 2, more of the power consumed by the antenna can be radiated in the form of RF energy. This means that the antenna 22 may be made more efficient and therefore more likely to meet a wireless wide area network (WWAN) service provider's certification requirement by simply moving the antenna 22 into the extended position. The position of the antenna may also affect the specific absorption rate (SAR). The extendable antenna design may prove critical in offering a design solution that embraces wireless broadband connectivity. For instance, a flat profile device such as a tablet PC may have difficulty meeting efficiency requirements while maintaining SAR regulation compliance without incorporating an extendable external antenna.

In a preferred embodiment, the antenna 22 may have an extendable range that is continuously adjustable between the extended position of FIG. 1 and the closed position of FIG. 2. As noted above, the antenna 22 may be shaped to perfectly fit within a recess 24 of an electronic device 20 when it is in the closed position. When the antenna 22 is moved into the recess 24 of the electronic device, it is protected by the industrial design of the device 20. Here, no portion of the antenna 22 protrudes from the outer footprint of the device casing, so that when closed, the exposed outer surface of the antenna 22 is flush with the adjacent outer surface of the device 20. As such, the antenna 22 may better withstand impact or force without sustaining damage because any impact or force will likely be born by the body of the electronic device 20 instead of the antenna 22 alone. Additionally, retracting the antenna 22 to the closed position reduces the overall profile of the device 20, making both the device 20 and antenna 22 less likely to be subject to any unintended force or impact resulting from the device bumping into or catching on a foreign object. Fully enveloping the antenna 22 within the structure of the device 20 when the antenna 22 is in the closed position may help the antenna to more closely adhere to the aesthetic design of the device so that it will be visually concealed when not in use.

Figure 3:
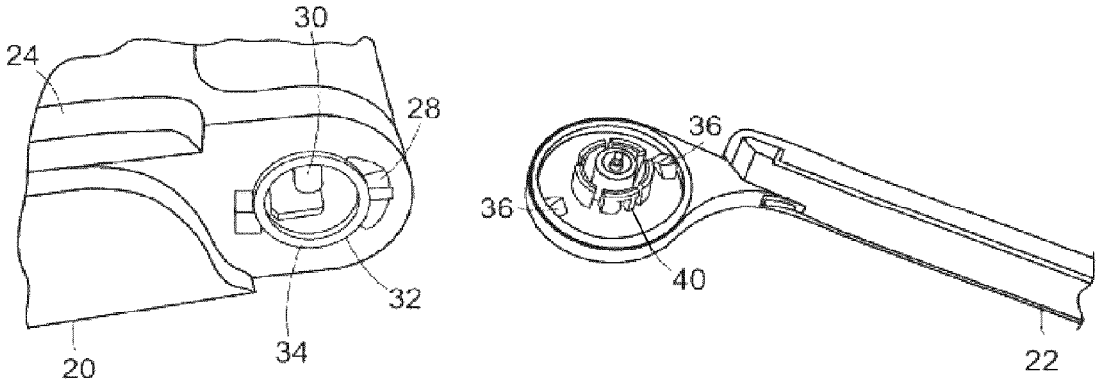
FIG. 3 is a broken plan view showing a portion of the exemplary electronic device that includes an embodiment of the integrated external antenna with the antenna removed to show the internal features of the extendable portion of the antenna and corresponding features of the body of the electronic device.
Figure 4:
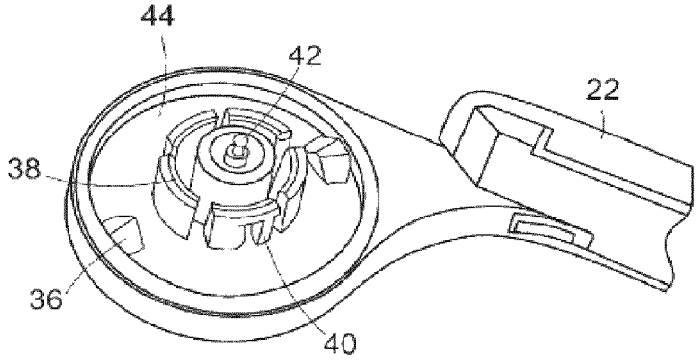
FIG. 4 is a plan view showing the extendable portion of the external antenna.

When a person using the electronic device 20 requires the antenna 22 to operate at increased efficiency, the person may rotate the antenna 22 out of the recess 24 into a second set position where it may operate at a higher efficiency. FIGS. 3 and 4 illustrate the more detailed features of the antenna's functionality as it is moved from one position to another. The antenna may have two types of operating orientations; extended and retracted, or, opened and closed. The fully extended and fully closed positions may be indicated to a user by including detent locations that cause the antenna to palpably snap into place when it reaches either position. The detent locations may be built into the rotating mechanism of the antenna and may help a user to feel whether the antenna is in the open or closed position. The first locating detent may ensure that the antenna is securely held in the recessed position so that it will be enveloped within the industrial design of the device when the antenna is in the closed position. This may help to prevent the antenna and device from being damaged when the antenna is retracted. The antenna may have full functionality in the closed position, but its efficiency may be limited as compared to the open position. When a person using the device requires enhanced antenna efficiency, the person may rotate the antenna into its extended position, or to any position between the closed position and the extended position. The extended position may be a preset angle at which the antenna is likely to achieve maximum performance, and correspond with the second detent location. When the antenna is rotated out from the envelope of the device, it may engage the second detent location when it is fully extended so that a user will feel that the antenna has reached the end of its allowed range of motion.

Even with a more robust design, the antenna may be subject to excessive force or impact when in the open position. While prior antenna designs may break, requiring the user of the device to buy new parts in order to repair the device, the antenna may have a breakaway feature. The breakaway feature may cause the antenna to detach from the device if it is subject to excessive force or impact. This feature may be accomplished by including small snaps into the rotation hub of the antenna, allowing the antenna to breakaway from the device so that both the antenna and device are less likely to sustain damage. Because the breakaway feature allows the antenna to snap off without incurring damage, a user may simply snap the antenna back into place without having to procure a replacement part or engage in a more time consuming or costly repair. Even if the antenna is lost or damaged, the antenna may be designed so that a user can easily replace it without a need for tools or technical assistance.

The breakaway feature may also be configured to dislodge the antenna if the end user accidentally and/or forcibly extends the antenna past the fully extended position indicated by the second detent location. To accomplish this ejection, cam shaped features may be designed into a portion of the device and the antenna to cause the antenna to eject from the body of the device when the cam features are forced together. Again, if this occurs, the end user can easily re-attach the antenna without professional assistance by pressing the antenna into the body of the device. Another important feature of the antenna is that it constrains the user from opening the antenna past the fully extended position. If a user exerts 'excess force' of a few kilograms, the antenna simply snaps off at the rotation point (central mounting hub).

The RF radiation that the user is exposed to may increase as the antenna is moved past 90° when the device is held by a user because rotating the antenna further is likely to result in moving the antenna closer to the body of the user. Accordingly, a user may be able to cause the device to not comply with SAR requirements if they are able to open the antenna to 180°. By snapping apart when the device is rotated past 100°, the antenna may prohibit a user from creating an unacceptable SAR condition. Because of the breakaway design, the antenna will not sustain damage when a user attempts to force it past the open position. The antenna may simply disconnect, thereby preventing the user from positioning the antenna in a way that may cause an illegal absorption condition. Accordingly, the breakaway feature makes the antenna both safer and more robust, and diminishes the need for replacement parts and technical support. It is also noted that while 100° is considered to be the fully open position of this embodiment, the open position may be configured to be any suitable angle.

FIG. 3 is a broken view showing the features of the antenna that are integrated into the body of the device 20 that engage and complement the external features of the antenna 22. The portion of the device 20 to which the antenna 22 is mounted may include two rotation stop/cam features 28 that function as both position stops and ejection features. These cam features 28 will engage corresponding cam features 36 of the external antenna 22 when the external antenna 22 reaches either its fully closed or fully extended position. Each cam feature 28 and 36 has a sloped surface, so the antenna 22 will be ejected from the device as the cams are forced together and their ramped surfaces engage. Because of the smooth manner in which the antenna 22 rotates, a user will easily feel the point at which the cam features of the device 28 and the cam features 36 of the antenna 22 begin to engage. This should signal the user to stop rotating the antenna. Here, the cam features 28 and 36 may play a vital role in maintaining compliance with SAR requirements. If the antenna 22 were extended beyond the fully extended position shown in FIG. 2, then the outer surface of the antenna 22 would be even with the bottom surface of the electronic device 20. Since the bottom surface of the device may be in contact with the body of the user, and SAR is at its highest point immediately at the surface of the antenna, this lack of clearance between the antenna and the body of the user may lead to the user's body absorbing RF energy in excess of SAR limitations. To ensure that a non-compliant SAR condition does not occur, the cam features 36 of the antenna 22 may engage the cam features 28 of the device 20, causing the antenna to disengage and thereby limiting the user's exposure to RF radiation.

FIG. 3 also shows two detent recesses 34. When these recesses 34 engage with the detent protrusions 40 of the antenna 22, a user may feel the protrusions snap into the recesses, indicating to the user that the antenna 22 is in the corresponding detent position (either the fully retracted or fully extended position). Engagement of the detent features also secures the antenna 22 in either the fully extended or fully retracted position, making it is less likely that the antenna will be inadvertently moved from either position. The snap feel associated with the antenna 22 detent features engaging may also indicate to the user that the antenna has reached the fully extended position so that the user will stop extending the antenna 22 and be less likely to force the antenna 22 to disengage from the body of the device 20. Like the cam features 28 and 36, the detent features 34 and 40 may serve the added function of helping to maintain SAR compliance. This is because the detent location may correspond with a specific angle of the antenna that does not subject the body of a user to excess RF electromagnetic radiation.

FIG. 4 shows an embodiment of the antenna 22 showing the features that engage the body of the device 20. As noted above, the antenna 22 includes cam shaped features 36 that engage corresponding features on the body of the device. The antenna also includes retention snaps 38 that are arranged arcuately about the antenna's axis of rotation to form a rotation hub. The retention snaps 38 protrude into the body of the device 20 when the antenna is installed and secure the antenna 22 in place. At two locations on the retention snaps 38, the antenna includes detent protrusions 40 that may engage with corresponding recesses 34 on body the device 20 so that the antenna will snap into the extended and retracted positions. It is noted that the retention snaps 38 and detent protrusions 40 are sized so that they will slide smoothly along a surface of the device 20 when the antenna is rotated. Specifically, the detent protrusions 40 and snaps 38 may be sized so that they are very slightly larger than the opening in the device 20, but able to easily compress so that the outer diameter of a hypothetical cylinder, or hub, formed by the retention snaps 38 will have a diameter that is exactly the same as the diameter of hole the device in which the antenna sits. This snug fit may result in a slight pressure being exerted against the recess in the device 20 by the retention snaps 38, which will ensure that the antenna 22 will rotate smoothly and evenly so that a user will experience a positive tactile feel while rotating the antenna between the closed and extended positions. The snug fit may also result in a small resistive (slip) friction force that serves to stabilize the antenna 22 in any static position between the closed and extended positions, allowing for continuous adjustability and positioning between the two terminal positions.

A benefit of the detent locations is that they serve to effectively hold the antenna in its intended position. The antenna design alleviates the need for a latching mechanism to hold the antenna in place because the detent features make the antenna resistive to unintended displacement. Also, since there are no latching mechanisms that may serve to limit the number of positions in which the antenna may rest, the antenna may be securely positioned at any point within its range of motion of 0 to 100° from the plane of the device. Another benefit of the antenna design is that, aside from spring elements, it does not contain any electrically active features that are subject to flex. This makes for a more robust design because the stresses and strains on the material will remain static. Thus, cracking or fatigue failure than may occur in parts and coatings that are subject frequent flexing and bending are unlikely to occur.

Returning to FIG. 3, a contact plate 30 of the device 20 that serves to form a constant pressure coupling with the pogo pin 42 of the detachable portion of the antenna is shown. A difficulty associated with an antenna design that allows the antenna to have a range of motion is that the antenna must remain constantly and consistently coupled to other transceiver elements of the device. In a case where the antenna rotates about an axis to move from an open position (outside of a recess in the device) to a closed position (inside a recess in the device), this coupling may be maintained by including a pogo pin 42 at the center of the antenna's axis of rotation. The pogo pin 42 may electrically couple the antenna 22 to the contact plate 30. The pogo pin 42 and contact plate 30 may be plated with gold or a similar material. Here, gold may be a preferred material because of its high conductivity, relatively high resistance to frictional wear at the point of contact, and resistance to oxidization and other types of corrosion. One or both of the contact plate 30 and the pogo pin 42 may be spring mounted so that they will maintain a connection having consistent electrical properties throughout the range of motion of the antenna 22. Maintaining a constant pressure contact point between the pogo pin 42 of the antenna and the internal components of the device is important because it maintains constant impedance. Changing the impedance is undesirable in this circumstance because doing so will undesirably affect the efficiency and performance of the antenna.

The antenna design disclosed herein may help system designers to contend with the competing interests of attaining compliance with SAR regulations while also attaining maximum antenna performance. Generally, extending an antenna away from a device's impedances to the antenna element(s) increases the gain and throughput of the antenna. This means that antenna performance can be maximized or improved by increasing the distance the antenna extends from an impedance increasing component of the device, such as a metal frame. As a simplified example, the capture range of a wireless local area network (WLAN) 2.45 GHz antenna is usually equal to ⅛ of its wavelength, or about 15.5 mm. Here, capture range refers to the distance from an antenna in which an obstruction will hinder the antenna's performance. In other words, the capture range is roughly the amount of clearance that an engineer should allocate between a distal end of the external antenna and the body of the electronic device so that the antenna will function optimally. Based on the calculation above, typical antenna design rules dictate that such an antenna should be no closer than 15.5 mm to the body of a device in order to minimize the device's effect on the antenna. However, because external antenna designs place the antenna closer to the body of the user, it is more difficult to design an external antenna into a device that is compliant with SAR regulations. Specifically, devices that incorporate an external antenna must still comply with SAR regulations, such as mandatory FCC Bulletin OET 65, and desirable EC Directive 1999/5/EC (available at http://www.fcc.gov/Bureaus/Engineering_Technology/Documents/bulletins/oet65/oet65.pdf and http://ec.europa.eu/enterprise/rtte/dir99-5.htm#Article %205, respectively) which are herein incorporated by reference. Because the external antenna is more likely to expose a user to RF related electromagnetic radiation, a device that is not designed carefully may fail to comply with energy absorption regulations in any direction (tested). Addressing this problem is important because noncompliance with SAR regulations will render a device unmarketable.

Figure 5:
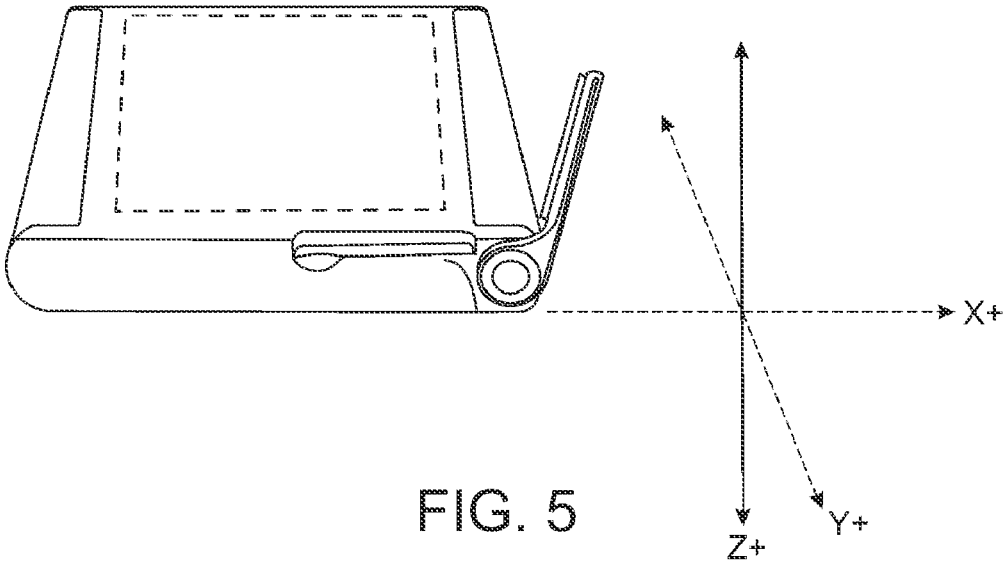
FIG. 5 is a plan view of an electronic device alongside a coordinate system for the purposes of illustrating how specific absorption rate measurements are interpreted.
Figure 6:
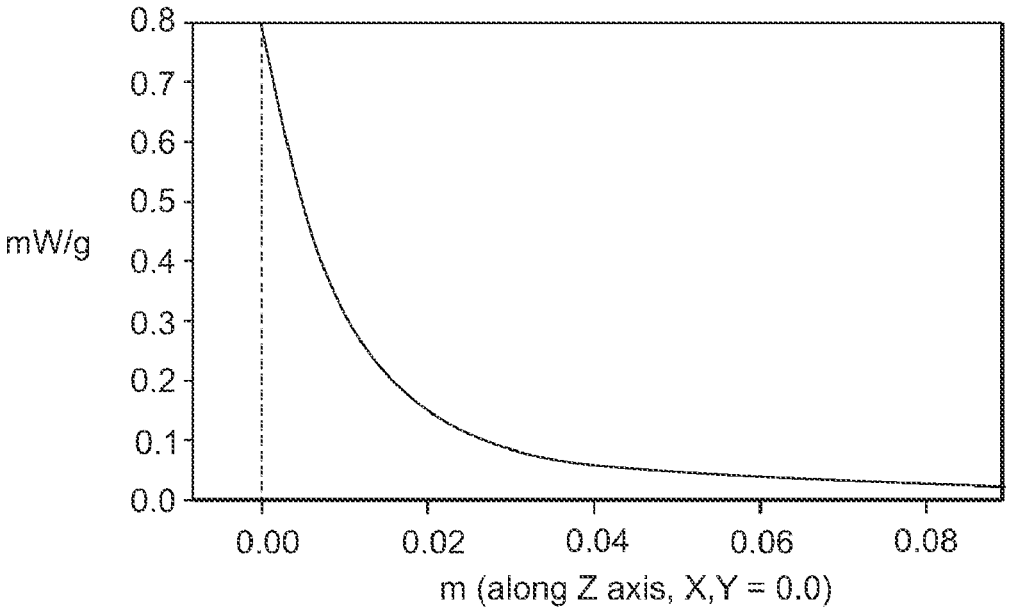
FIG. 6 is a graph showing the specific absorption rate of an exemplary electronic device taken along the positive Z axis of FIG. 5.

Generally, SAR limitations may be different depending on the intended use of a device. For instance, if a device is intended to be near or in contact with a sensitive part of the user's body such as the head, then the most stringent SAR requirement may be imposed. If the device is intended to be in contact with less sensitive parts of the user's body, such as the user's extremities, then an intermediate SAR requirement may be imposed. Also, as noted above, SAR is observed to decrease exponentially over distance. To illustrate, FIG. 6 is a graph showing SAR measurements taken from the bottom surface of a tablet computer that employs an embodiment of the antenna along the Z-axis illustrated in FIG. 5. In particular, FIG. 6 shows how SAR declines over distance as the measurements are taken at various locations immediately next to the device and moving progressively away from the device. SAR measurement at the bottom surface of the device were measured to be approximately 0.76 mW/g, at 5 mm away from the device the SAR measurement is already decreased to approximately 0.44 mW/g, and 10 mm the SAR measurement has declined to 0.28 mW/g.

Figure 7A:
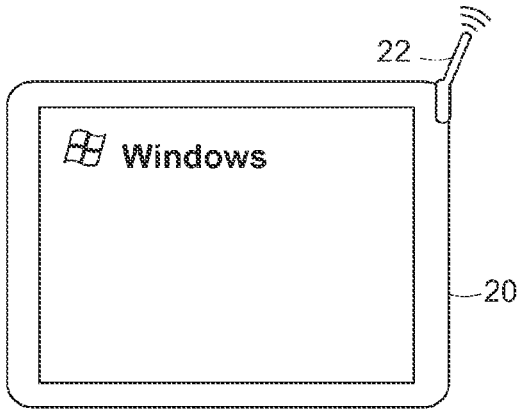
FIG. 7*a* shows a top view of an electronic device with an acceptable "landscape" display configuration.
Figure 7C:
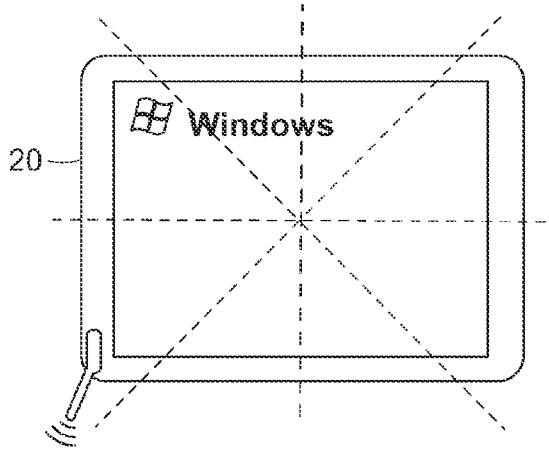
FIG. 7*c* shows a top view of an electronic device with an unacceptable "landscape" display configuration.
Figure 7B:
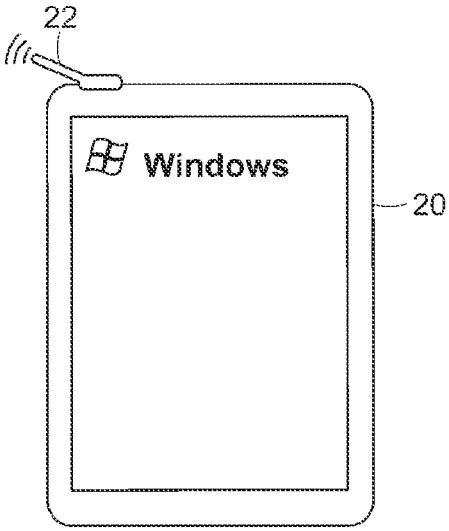
FIG. 7*b* shows a top view of an electronic device with an acceptable "portrait" display configuration.
Figure 7D:
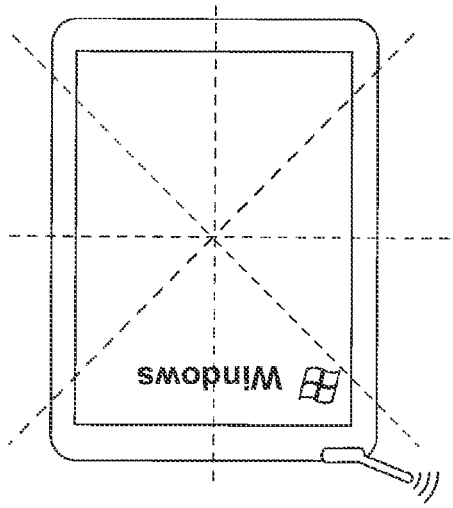
FIG. 7*d* shows a top view of an electronic device with an acceptable "portrait" display configuration.

An additional benefit, in terms of attaining SAR compliance, of the antenna design is that it is located at a corner of the device. Accordingly, the display mode of the device may be configured such that the antenna will always be on the opposite site of the device of the anticipated location of the user. In other words, an electronic device, such as a tablet PC, may be viewable from any one of its four sides. Here, the display control software of the device may be configured so that the display may only be viewed from the two sides of the device that are not adjacent to the corner of the device where the antenna is located. By putting space in between the antenna and the body of the user, SAR compliance will be easier to attain. To illustrate, FIGS. 7*a* and 7*b* show the device 20 with display configurations that are acceptable because the antenna 22 will be on the opposite side of the body of the device 20 from the antenna 22. Conversely, FIGS. 7*c* and 7*d* show the device 20 with unacceptable display configurations. In the display configurations show in FIGS. 7*c* and 7*d*, the antenna is oriented on the same side of the device 20 as the body of a user. These screen orientations are unacceptable because direct contact with the antenna 22 is much more likely to cause the device to be out of compliance with SAR requirements.

Accordingly, an external antenna is disclosed that may have a limited range of motion that allows it to change positions in order to reach higher efficiencies while still having its range of motion limited so that it cannot be maneuvered into a position in which it will emit an unacceptable amount of RF electromagnetic radiation in a particular direction. This feature may allow the device to maintain SAR compliance by not radiating an excessive amount of RF electromagnetic energy into the body of a user, even the user is holding the device in their lap. The antenna will be ejected from the body of the device by the breakaway feature described above if it is forced toward a position that would cause it to exceed limitations of acceptable radiation levels.

The antenna design allows a user to rotate the antenna continuously up through all angles to allow the highest gain or efficiency, thereby achieving increased transmission and reception throughput. It is also noted that because multiple radio bands operate at multiple wavelengths, the ideal 'capture range' and distance by which an antenna should extend from a device will fluctuate according to the transmission mode in use. In other words, the ideal amount of antenna extension is a fluctuating quantity, which means that a user may be able to get better performance at different points along the path through which the antenna sweeps between its closed and extended positions. However, it is theorized that the antenna will achieve optimum performance at the 800 MHz, 900 MHz, 1800 MHZ, 1900 MHz, and 2100 MHz frequencies when the antenna is fully extended. Thus, in some embodiments, the antenna may allow a user to rotate the antenna to a highest gain or highest efficiency position that is not the fully extended position. The rotation of the antenna may be limited by a mechanical limiting feature such as the detent locations or ejection cams described above. This may allow the antenna to rotate or extend up to the point in which it is near SAR limits, but not to a position in which it will exceed the limits. It is noted that the ideal position for maximum extension may be determined through testing at different radio bands (different frequencies and wavelengths). In other words, the ideal maximum extension angle may vary slightly according to the application.

It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An antenna apparatus configured to detach from a housing of an electronic apparatus when the antenna apparatus is rotated beyond a fully extended position, comprising:

an antenna having opposed distal ends;

a cylindrically shaped pin located near one of the distal ends and extending from a side of the antenna apparatus, wherein a central axis of the pin serves as an axis of rotation for the antenna apparatus;

a detent, operably shaped to palpably engage the antenna apparatus in a fully extended position when the antenna apparatus is rotated about the central axis to a first angle; and a cam having a sloped surface that is operably shaped to detach the antenna apparatus from the housing of the electronic apparatus when the antenna is rotated beyond the first angle.

2. The antenna apparatus of claim 1, wherein the sloped surface of the cam is operably shaped to engage a sloped surface of a cam included within the housing of the electronic apparatus, and wherein when the antenna apparatus is rotated about the central axis to a second angle greater than the first angle, the sloped surfaces of the cams included within the antenna apparatus and the electronic apparatus force the antenna apparatus to separate away from the electronic apparatus.

3. The antenna apparatus of claim 1, wherein the pin is coupled to a spring for biasing the antenna outward.

4. An electronic apparatus, comprising:

an electronic apparatus housing having a planar surface on which an electronic display is mounted and side surfaces along the lateral extents of the planar surface, with an aperture extending into one of the side surfaces;

an antenna having a singular pin extending along an axis of rotation of the antenna from a side surface of the antenna near one of a pair of opposing distal ends of the antenna, wherein the pin is biased outward along the axis and against an opposing biased contact plate configured within the aperture of the electronic apparatus;

a set of arcuate protrusions mounted on the antenna and spaced radially outside the pin;

a first cam mounted on the antenna and radially outside the set of protrusions;

a second cam mounted on the computer and spaced radially outside the aperture; and wherein the first and second cams are configured to engage and disengage with each other when the pin is rotatably inserted into the aperture.

5. The electronic apparatus of claim 4, wherein the aperture comprises a central axis and a contact plate yieldably biased outward from within the computer housing along the central axis of the aperture.

6. The electronic apparatus of claim 4, wherein the aperture comprises a circular recess located on an axis that is approximately parallel to the lateral surface of the computer and approximately perpendicular to the side of the portable computer; and near the rearmost lateral extent of the electronic apparatus.

7. The electronic apparatus of claim 4, wherein the protrusion is yieldably biased outward from the antenna to remain in physical contact with the contact plate when the protrusion is rotably inserted into the aperture.

8. A method for extending an antenna, comprising:

inserting a fingertip into a recess within a side surface of a electronic system housing, between the recessed portion of the side surface and an antenna;

applying force onto the antenna in a direction substantially perpendicular to a planar surface of the electronic system housing having an electronic display;

applying rotational force onto the antenna to rotate the antenna about a pivot point at which only one end of the antenna is rotably affixed to the side surface of the electronic system housing;

discontinuing the application of rotational force when detents on the antenna palpably engages with mating detents on the computer housing; and thereafter by continuing the application of rotational force, the antenna separates from the side surface of the electronic system housing.

9. The method of claim 8, further comprising maintaining a constant pressure coupling of the antenna throughout the range of motion of the antenna.

10. The method of claim 8, further comprising rotating the antenna about the internal radial surface of the aperture.

11. The method of claim 8, further comprising:

continuous application of rotational force to engage a cam on the antenna with a mating cam on the electronic system housing; and arranging said cam surfaces at an angle that will generate a force to separate the antenna from the electronic system housing when the cam on the antenna is engaged with the cam on the electronic system housing.

12. The method of claim 8, further comprising continuously adjusting the antenna throughout its range of motion to position the antenna to obtain optimal antenna efficiency.

13. The method of claim 8, wherein the cam of the electronic system housing and the cam of the antenna engage one another when a person attempts to move the antenna to a predetermined angle.

14. An antenna system, comprising an internal assembly and an external assembly, wherein the external assembly comprises:

intermittently placed, arcuate set of protrusions extending from a first side surface of the antenna near one of a pair of distal ends of the antenna;

and a singular pin also extending along an axis extending equidistant from each of the set of protrusions from the first side surface; and wherein the singular pin is biased outward along the axis and against an oppositely biased contact plate when the protrusions are rotably inserted into an aperture; and wherein the internal assembly comprises:

a circular recess configured to receive the intermittently placed, arcuate set of protrusions; and a contact plate, biased toward the external assembly, wherein the contact structure is coupled to a transceiver.

15. The antenna system of claim 14, wherein the external assembly moves rotationally from the internal assembly about a common axis of the arcuate set of protrusions and circular recess.

16. The antenna system of claim 15, wherein:

the external and internal assemblies each comprise slanted protrusions that are arranged an equal distance from the axis of the circular recess;

wherein the slanted protrusions will come into contact with one another when the external assembly reaches a predetermined orientation relative to the internal assembly; and wherein said contact will cause the external assembly to decouple from the internal assembly.

17. The antenna system of claim 16, wherein:

the external assembly is reattached to the internal assembly by forcing the arcuate set of protrusions into the circular recess; and wherein the singular pin of the internal assembly couples with the contact plate of the internal assembly when the external assembly is reattached to the internal assembly.

18. The antenna system of claim 16, wherein the slanted protrusions are positioned to limit the range of motion of the external assembly with respect to the internal assembly to between 0 and 100° of rotation.

19. The antenna system of claim 14, wherein the arcuate set of protrusions of the external assembly is sized so that a frictional resistance force will impede motion about the axes of the circular protrusion and the circular recess.

20. The antenna system of claim 19, wherein the frictional resistance force will cause the external assembly to remain motionless with respect to the internal assembly at any point within the range of motion of the external assembly unless the external assembly is subject to a force that exceeds the frictional resistance force.

21. The antenna system of claim 14, wherein:

the arcuate set of protrusions of the external assembly comprises a set of detent protrusions;

the circular recess of the internal assembly comprises a set of detent recesses;

a detent protrusion and detent recess will engage one another an exert an additional force on the external assembly external assembly to cause the external assembly to remain static when the external assembly is at the initial point in its range of motion; and a detent protrusion and detent recess will engage one another an exert an additional force on the external assembly external assembly to cause the external assembly to remain static when the external assembly is at the terminal point in its range of motion.

* * * * *